US008035044B2

(12) United States Patent
Hustert et al.

(10) Patent No.: US 8,035,044 B2
(45) Date of Patent: Oct. 11, 2011

(54) SERVICE SWITCHING DEVICE WITH DOUBLE-BREAK CONTACTS

(75) Inventors: Frank Hustert, Waghaeusel (DE); Ralph Burkhardt, Neckargemuend (DE)

(73) Assignee: ABB AG, Mannheim (DE)

( * ) Notice: Subject to any disclaimer, the term of this patent is extended or adjusted under 35 U.S.C. 154(b) by 375 days.

(21) Appl. No.: 12/412,907

(22) Filed: Mar. 27, 2009

(65) Prior Publication Data

US 2009/0242373 A1 Oct. 1, 2009

(30) Foreign Application Priority Data

Mar. 28, 2008 (DE) ..... 10 2008 016 036

(51) Int. Cl.
*H01H 13/12* (2006.01)
*H01H 67/02* (2006.01)

(52) U.S. Cl. ..... 200/16 A; 200/243; 335/132

(58) Field of Classification Search ..... 200/16 R–16 D, 200/17 R, 400, 401, 424–429, 440, 443, 446, 200/447, 449, 452, 453, 457, 459, 239, 243, 200/245, 246, 247
See application file for complete search history.

(56) References Cited

U.S. PATENT DOCUMENTS 4,616,117 A * 10/1986 Kleine ..... 200/243
4,893,102 A * 1/1990 Bauer ..... 335/132
4,982,060 A 1/1991 Streich et al.
5,218,332 A * 6/1993 Blanchard et al. ..... 335/132
5,233,321 A 8/1993 Blanchard et al.
5,276,417 A * 1/1994 Blanchard et al. ..... 335/132
5,339,060 A * 8/1994 Blanchard et al. ..... 335/132
5,546,062 A * 8/1996 Duchemin ..... 335/132
5,886,602 A 3/1999 Burel et al.
6,150,909 A * 11/2000 Meier ..... 335/132
6,310,528 B1 * 10/2001 Kuboyama et al. ..... 335/132
6,833,777 B2 * 12/2004 Bollinger et al. ..... 335/6
6,924,449 B2 * 8/2005 Duchemin et al. ..... 200/531

FOREIGN PATENT DOCUMENTS

AT 207933 3/1960

(Continued)

OTHER PUBLICATIONS

German Search Report of German Application DE 10 2008 016 036.9 mailed Aug. 13, 2008.

*Primary Examiner* — Michael Friedhofer
(74) *Attorney, Agent, or Firm* — Leydig, Voit & Mayer, Ltd.

(57) ABSTRACT

An electrical switching device comprises a contact point having two double-break contacts, a contact link having a width, a contact pressure spring exerting a pressure on the contact link, a striker pin configured to act on the contact link counter to the pressure of the contact pressure spring during a switch-off operation so as to move the contact link into an open position, and a thruster actuatable by a switching mechanism and configured to guide the striker pin, the thruster having two limbs projecting in the same direction towards a free end of the thruster so as to form a slot there between, wherein a distance between the two limbs tapers towards the free end such that the distance at the free end is smaller than the width of the contact link, so that the contact link is clamped between the two limbs during the switch-off operation.

7 Claims, 4 Drawing Sheets

FOREIGN PATENT DOCUMENTS

| | | |
|---|---|---|
| DE | 8805875 | 9/1989 |
| DE | 19540972 | 5/1997 |
| DE | 29714318 | 12/1997 |
| DE | 69614657 | 3/2002 |
| DE | 102006055007 | 5/2008 |
| EP | 0501844 | 9/1992 |
| WO | WO-2005062333 | 7/2005 |

* cited by examiner

SERVICE SWITCHING DEVICE WITH DOUBLE-BREAK CONTACTS

Priority is claimed to German Patent Application DE 10 2008 016 036.9 filed on Mar. 28, 2008, the entire disclosure of which is incorporated by reference herein.

The invention relates to a service switching device with double-break contacts, a contact link which is brought by a striker pin, counter to the pressure of a contact pressure spring, during a switch-off operation into the open position, for at least one pole current path, with a thruster, which can be actuated by a switching mechanism and in which the striker pin is guided, the contact link being accommodated in a slot in the thruster, which slot is formed by two limbs projecting in the same direction.

BACKGROUND

Generic service switching devices, for example motor circuit breakers, have at least one pole current path with a double contact point and two fixed contact pieces and two moveable contact pieces arranged on a moveable contact link.

In this case, the contact link is acted on by means of a thruster in the opening direction and by means of a contact pressure spring in the closing direction.

Furthermore, generic service switching devices comprise an electromagnetic release, whose armature, in the event of the occurrence of a short-circuit current in the pole current path, both acts on the contact link in the opening direction via the thruster and unlatches the latching point of a switching mechanism, with the result that the switching mechanism acts on the contact link permanently counter to the force of the contact pressure spring so as to open said contact link via an active lever.

Directly after the contact link has been acted upon and therefore directly after the interruption of the short-circuit current in the pole current path, the electrodynamic reaction of the electromagnetic release breaks down and the contact link is acted upon again in the direction towards its closing position by the force of the contact pressure spring.

Owing to the relatively high level of mechanical inertia of the switching mechanism, compared with that of the system comprising the armature and the thruster, the active lever lags the thruster movement in order to keep the contacts permanently open by means of the switching mechanism.

Under unfavourable conditions it may arise that the contacts have already been closed again by the contact pressure spring before the switching mechanism can bring about a permanent opening via the active lever and the thruster. This is then referred to as an occurrence of contact bounce, which is undesirable.

In order to avoid contact bounce, DE 10 2006 055 007.2 proposes using a slide and a striker pin as thruster, of which the striker pin is guided within the slide, the arrangement comprising the slide, the striker pin, the contact link, the active lever and the armature being designed such that, in the event of a short circuit, the armature accelerates the striker pin very rapidly owing to the small mass thereof and therefore acts very quickly on the contact link. In this case, the slide lags the striker pin before the active lever, via the slide, keeps the contact link permanently in the open position counter to the contact pressure force.

If the contact link has been acted upon and, as a result, the short-circuit current has been interrupted, the force effect of the armature on the striker pin also ends. The contact link is now pushed in the closing direction again by the force of the contact pressure spring.

The slide, which lags the striker pin, can brake this countermovement of the contact link, with the result that the contact link is prevented from closing the contacts before the active lever, which still continues to lag the striker pin owing to the relatively high level of mechanical inertia of the switching mechanism, finally keeps the contact link permanently in the open position via the slide.

In this case, the inertia of the striker pin and a low level of friction between the mechanical striker pin and the slide are utilized such that the striker pin keeps the contact link open for a sufficient period of time until the effect of the slide sets in during the triggering of the switching mechanism.

SUMMARY OF THE INVENTION

An aspect of the present invention is to provide a generic service switching device with further improved dynamic response for the interruption of short circuits whilst avoiding contact bounce.

The present invention provides a generic switching device wherein a distance between two limbs tapers towards a free end, the distance at the free end being smaller than the width of a contact link, with the result that said contact link can be clamped between the limbs in the event of a switch-off operation. This results in a clamping region at the free end of the limbs and a guide region being produced in the region between the free end of the limbs and the attachment point of the limbs to a thruster, in which guide region the contact link is guided moveably.

In accordance with an advantageous embodiment, the limbs are designed to be spring-elastic. In this case, in accordance with a further advantageous embodiment, the limbs can be bent towards one another towards the free end. They could also be bent back towards one another in the form of a V in the region of their free ends.

The advantageous effect of the configuration according to the invention of a generic service switching device consists in the fact that, when the contact link is acted upon, said contact link is clamped between the limbs of the thruster and, as a result, premature bouncing-back of the contact link in the direction of the closing position is prevented. If the contact link is fixedly clamped, it can only continue to move together with the thruster.

In an advantageous development of the invention, means are provided which, owing to a movement of the thruster, can bring the contact link free from the limbs again. This is helpful if, once the contact link has been acted upon, for example if the short circuit has died out, the service switching device is intended to be switched on again by a renewed switch-on operation.

In an advantageous embodiment of the invention, the abovementioned means are a web or a journal, against which the contact link rests in the switch-off position, with the result that, during a further movement of the thruster, the web or the journal brings the contact link free from the limbs in the switch-off direction again.

This further movement of the thruster can take place during resetting, for example, by virtue of the fact that the thruster is pushed a bit further in the direction of the switch-off position by the active lever. Owing to the fact that it rests on the web or journal, the contact link can no longer follow this further movement of the thruster and is thus brought into the guide region of the slot again, counter to the clamping and frictional force relative to the longitudinal extent direction of the limbs, in which guide region it can then be pushed into its closing position again by the contact pressure spring.

In a further advantageous embodiment, it is also possible for the means to be a spring, which, during a further movement of the thruster, moves the contact link in the switch-off position from the clamping region between the limbs, with the result that the contact link is brought free from the limbs into the guide region. The unclamping of the contact link by the spring takes place when the restoring force of the compressed spring is greater than the clamping force which the limbs exert on the contact link.

Further advantageous configurations and improvements of the invention are described in the claims.

BRIEF DESCRIPTION OF THE DRAWINGS

The invention and further advantageous configurations and improvements and further advantages of the invention will be explained and described in more detail with reference to the drawing, which illustrates two exemplary embodiments of the invention and in which:

In FIGS. 1 to 4, identical or functionally identical elements or assemblies have each been denoted by the same reference numerals.

DETAILED DESCRIPTION

Figure 1A:
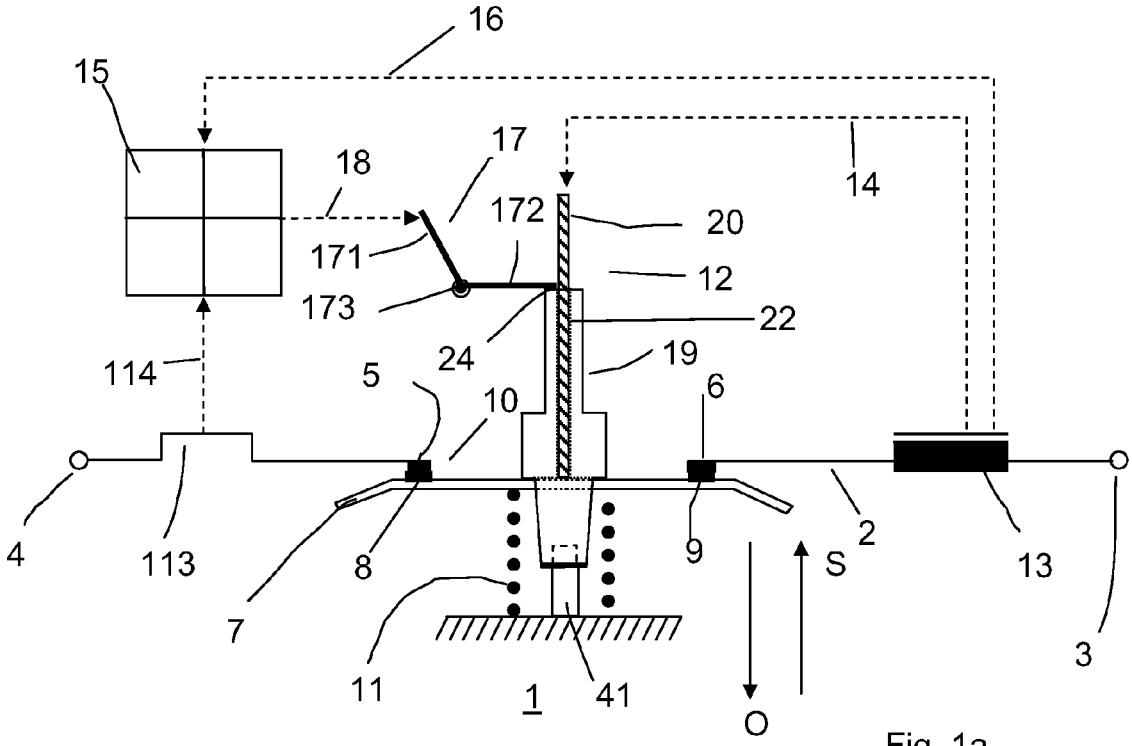
FIG. 1*a* shows a function schematic diagram of a service switching device with a thruster in the rest position.
Figure 1B:
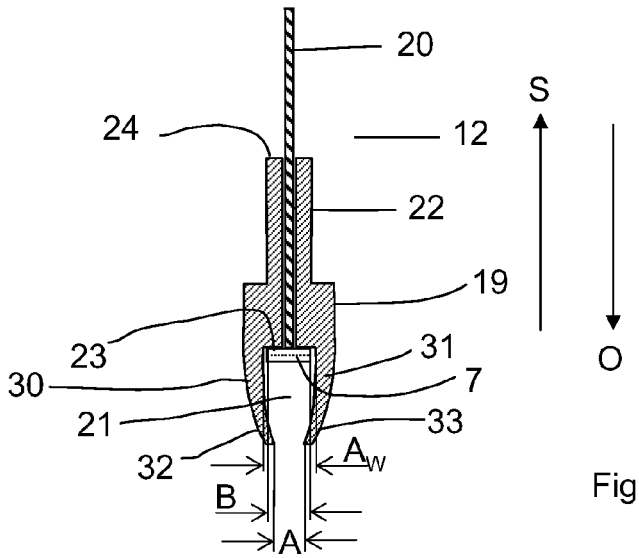
FIG. 1*b* shows a longitudinal sectional view of the thruster shown in FIG. 1*a* in the rest position.

FIG. 1 shows a service switching device 1 according to the invention with a pole current path 2 between an input terminal 3 and an output terminal 4. It could be, for example, a pole current path of a three-pole motor circuit breaker, whose other two pole current paths are constructed correspondingly but are not illustrated here.

The pole current path 2 comprises two fixed contact pieces 5, 6 and two moveable contact pieces 8, 9, which are arranged on a moveable contact link 7 and which form a contact point 10 with double-break contacts. The contact link 7 is acted upon by a contact pressure spring 11 in the closing direction, see direction arrow S. The contact link 7 can be acted upon in the opening direction, see direction arrow O, by a thruster 12, which acts on that side of said contact link 7 which is opposite the contact pressure spring 11.

The pole current path 2 also comprises a thermal release 113, which is only illustrated for reasons of completeness, and an electromagnetic release 13 with a moveable armature, which acts on the contact link 7 in the opening direction in the case of a short-circuit current occurring in the pole current path 2 as a result of electrodynamic forces via the thruster 12, as is indicated by the line of action 14. At the same time, the armature of the electromagnetic release 13 also acts in the event of a short circuit on a switching mechanism 15 and unlatches the latching point thereof, indicated by the line of action 16, with the result that the switching mechanism 15 in the unlatched state acts on the thruster 12 permanently in the opening direction of the contact link 7 via an active lever 17, indicated by the line of action 18. In the event of high short-circuit currents, electrodynamic opening of the double contact point 10 as a result of the current flow in the pole current path can also take place.

The function of the thermal release 113 which, in the event of an excess current, likewise acts on the switching mechanism 15, indicated by the line of action 114, is known in principle and is not the subject matter of the present invention.

The mechanical system comprising the switching mechanism 15 and the active lever 17 may be, for example, a toggle system with two-stage latching. The active lever 17 is in the form of a double-arm lever, whose first lever arm 171, which is acted upon by the switching mechanism 15, and whose second lever arm 172, which interacts with the thruster 12, form an obtuse angle with one another, and is mounted rotatably in a stationary rotary spindle 173, as a result of which the active lever 17 acts as a deflecting lever. However, the active lever could also have a different shape.

This just-described mechanical system has a certain mechanical inertia, as a result of which a certain amount of time, for example 3 ms, passes after unlatching before the active lever 17 meets the thruster 12 in order to act upon said thruster permanently in the opening direction.

In contrast, the time until the armature, which in this case acts as a striking armature, of the electromagnetic release 13 directly hits the contact link 7 is much shorter; it is, for example, only 1 ms.

As a result, it could arise, if no further measures are taken, that the contact link 7, owing to the restoring force of the contact pressure spring 11, is already pushed back into its initial position in the closing position again and the contact point 10 is as a result closed again before the active lever 17 with the free end of its second arm 171 can act on the thruster and therefore act on the contact link 7 permanently in the opening position.

The thruster 12 is formed in two parts, corresponding to the configuration in accordance with DE 10 2006 055 007.2, and comprises a slide 19 and a striker pin 20. As can be seen in the sectional illustration in FIG. 1*b*, the thruster 12 is an elongate component part with an approximately cylindrical basic shape.

In a first, slot-like opening 21 in the slide 19, which is open at the bottom towards the narrow side of the slide 19, the contact link 7 is guided displaceably in its closing or in its opening direction.

The striker pin 20 is guided moveably in a second, channel-like opening 22 in the slide 19 likewise in the closing or opening direction of the contact link 7. It protrudes beyond the slide 19 upwards in the direction of the point of action of the striking armature.

A first shoulder 23, which acts as an upper stop for the contact link 7, is formed in the first opening 21 of the slide 19. A second shoulder 24, which acts as a point of action for the active lever 17, is formed on the slide 19 at the end opposite the contact link 7.

The first opening 21 is formed by two fork-like projections or limbs 30, 31 which project in the longitudinal direction of the slide 19 and take the contact link 7 between them. The free ends 32, 33 of the prongs 30, 31 have a smaller distance A between them than the distance $A_W$ at the shoulder 23. The distance A is also smaller than the width B of the contact link 7. In the drawing, the shape of the limbs 30, 31 is represented as being slightly curved; it is naturally also possible for the limbs 30, 31 to be bent back towards one another for example in their centre, with the result that they form a V shape in the region of the free ends.

A clamping region for fixedly clamping the contact link 7 is therefore produced at the free ends 33, 32 of the limbs 30, 31, and a guide region for the contact link, in which guide region said contact link can be guided moveably, is produced between the free ends 33, 32 and the first shoulder 23 at which the limbs 30, 31 are attached to the thruster body.

Figure 2A:
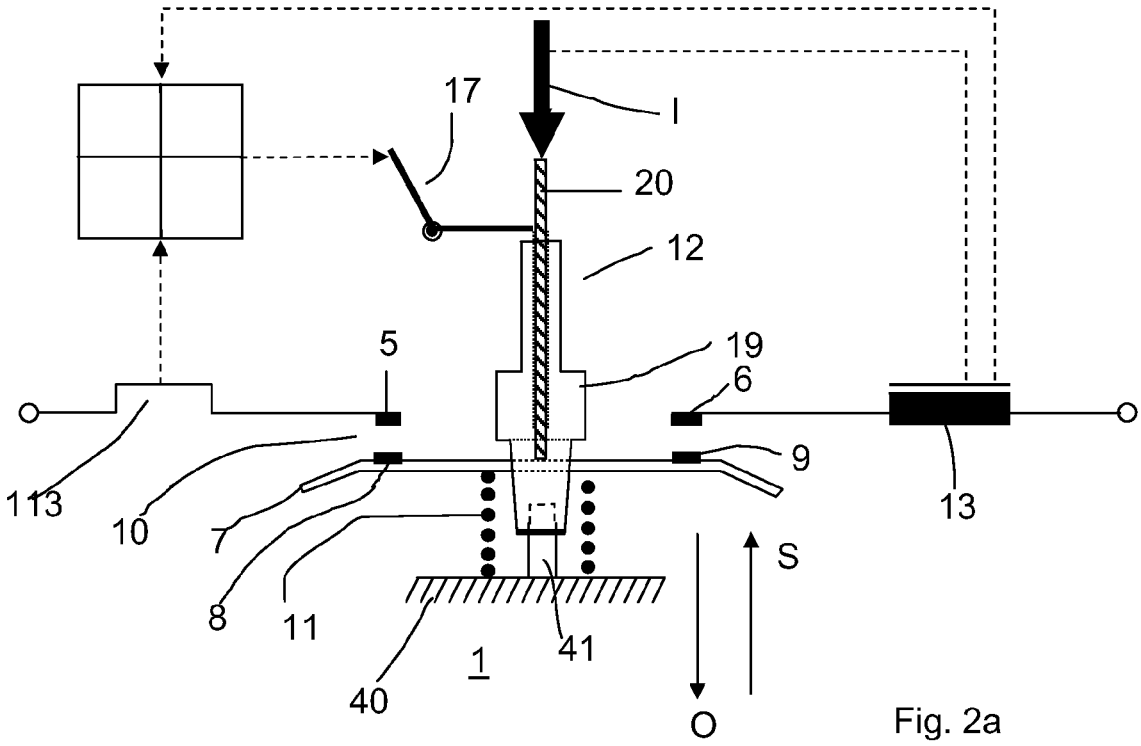
FIG. 2*a* shows the function schematic diagram of the service switching device with the thruster, as shown in FIG. 1*a*, shortly after the occurrence of a short-circuit current.
Figure 2B:
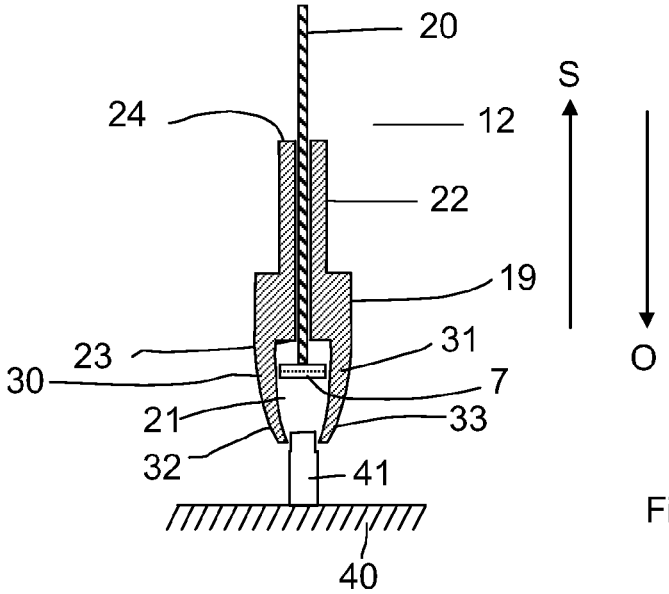
FIG. 2*b* shows a sectional view of the thruster shown in FIG. 2*a*, similar to that shown in FIG. 1*b*.
Figure 3A:
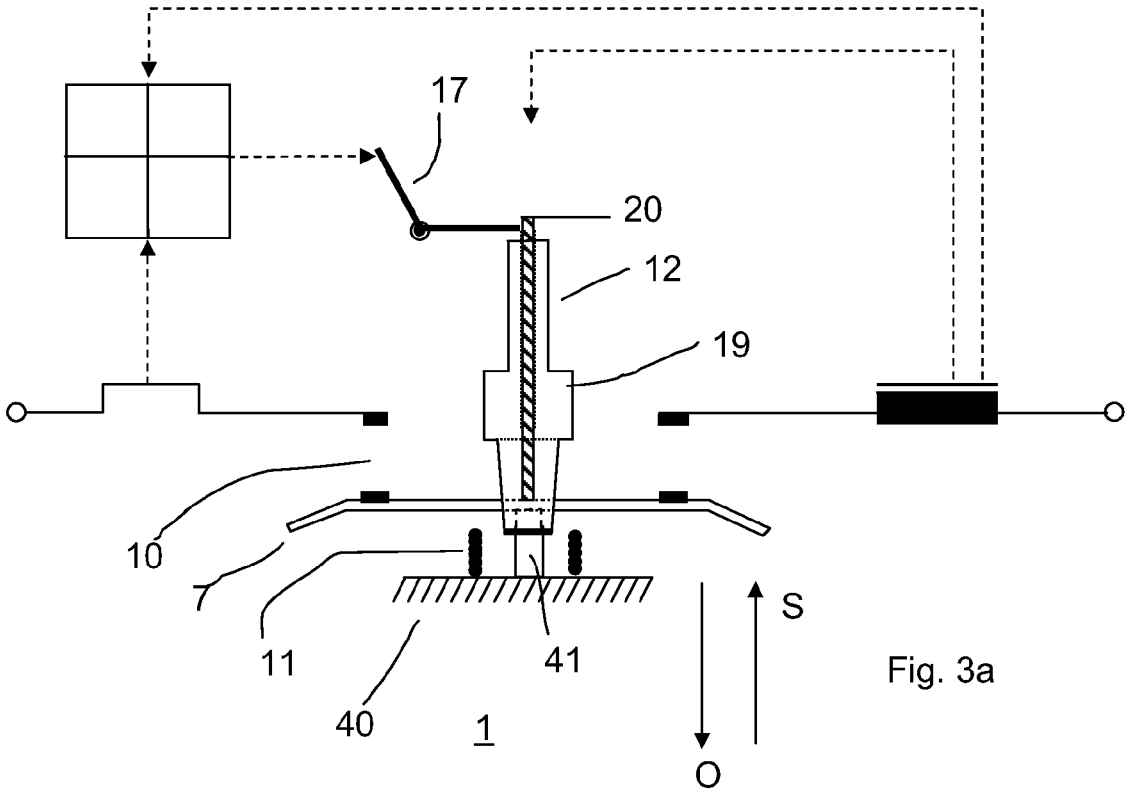
FIG. 3*a* shows the function schematic diagram of the service switching device with the thruster shown in FIGS. 1*a*, 2*a* given a maximum deflection of the contact link in the opening direction.
Figure 3B:
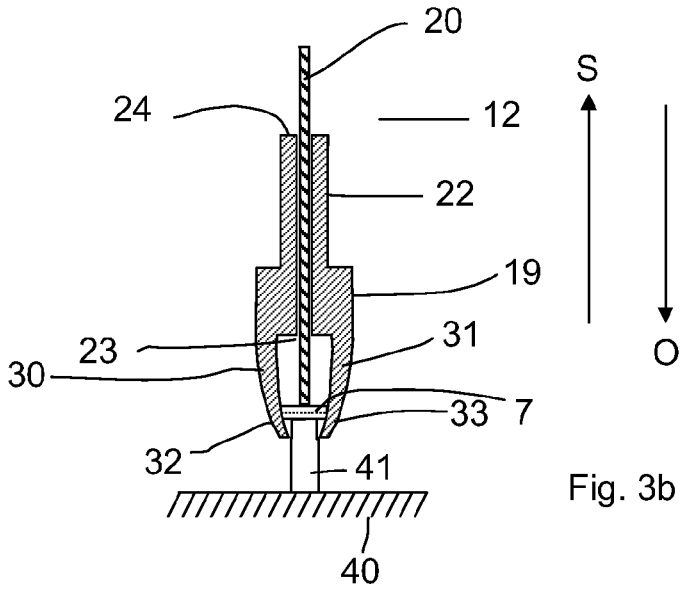
FIG. 3*b* shows a sectional view of the thruster similar to that in FIGS. 1*b* and 2*b* as shown in FIG. 3*a*.

The function of the arrangement according to the invention in the event of the occurrence of a short-circuit current will now be explained below. If a short-circuit current occurs, see FIG. 2*a*, the armature of the release 13 strikes the striker pin 20 of the thruster 12, indicated by the pulse arrow I in FIG. 2*a*. The striker pin 20 is accelerated downwards in the opening direction O, with it carrying along the contact link 7 in the opening direction O and moving it away from the stop 23. As a result, the moveable contact pieces 8, 9 are separated from the fixed contact pieces 5, 6 and the double contact point 10 is opened. As a result of this downward movement of the striker pin 20, the contact link 7 enters the tapered region and is held fixedly between the prongs 30, 31 by being clamped, since the distance A between the projections or the prongs 30, 31 is reduced. As it moves into the tapered region, the contact link 7 carries along the slide 19 for a certain distance, the slide 19 then being fixedly held by the active lever 17, even if said slide 19 is carried along owing to the return movement of the contact link 7 by said contact link 7 owing to the friction (the fact that it is clamped). In any case, the double contact point 10 remains open. It is essential that the distance between the tapering of the prongs or the opening 21 and the shoulder 23 is sufficiently great.

A journal 41, which engages partially in the slot 21, is integrally formed, fixed in position, on the housing 40, of which only part is illustrated. The contact link 7 enters the immediate vicinity of the end of the journal 41 and the contact link 7 can come free from the projections by the slide 19 being pushed lower still (for example by a reset button), with the result that the contact link 7 is brought back into the switch-on position by the contact spring.

Figure 4:
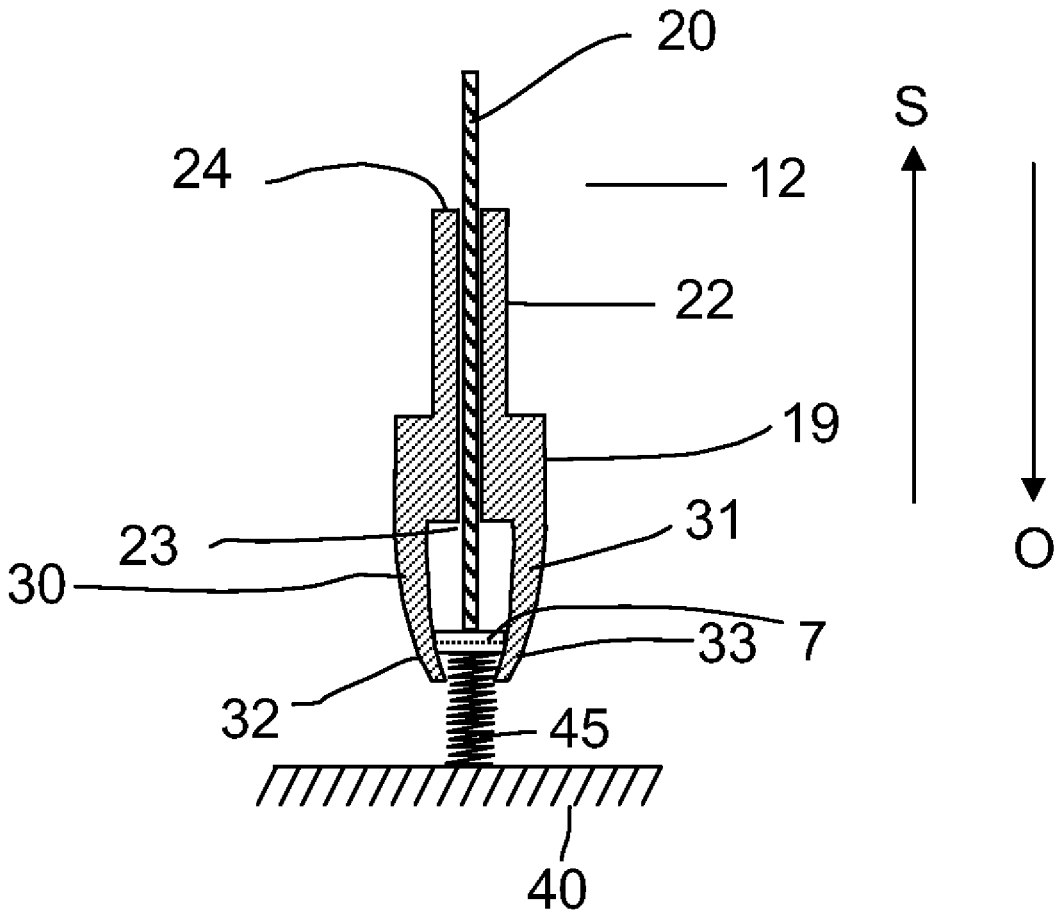
FIG. 4 shows a sectional view of the thruster of a further configuration of a service device.

Instead of a journal 41, a pressure spring 45 can also be provided (see FIG. 4), the pressure spring being correspondingly dimensioned such that it can overcome the frictional force if a switch-on operation is performed.

A further advantageous effect of the configuration according to the invention also arises when the striking movement of the contact link is insufficient for it to be pushed into the clamping region to such an extent that it is clamped there fixedly. This is because, owing to the curved inner contour of the slot which is produced by the curved shape of the limbs, there is also already a certain amount of friction between the contact link 7 and the inner sides of the limbs 30, 31 in a region which is still just above the clamping region. This is a transition region between the guide region and the clamping region. Owing to the friction between the contact link 7 and the limbs 30, 31 in the intermediate region, the movement of the contact link 7 relative to the limbs 30, 31 there is already slowed down. A delay in the movement of the contact link therefore also already results when said contact link should not be pushed completely into the clamping region. The delay achieved in this way can also already be sufficient for effectively avoiding contact bounce.

It should also be mentioned that the above-described effect according to the invention also occurs when the opening of the contact link first takes place not by the striker pin but as a result of an electrodynamic repelling action between the fixed and moveable contact pieces. In particular in the case of high current levels of a short-circuit current, the electrodynamic repelling effect is more rapid than the response time of the electromagnetic release 13. The armature of the electromagnetic release 13 therefore lags the electrodynamic repelling effect of the contact point 10. Even if the contact link 7 is pushed downwards into the clamping region of the slot 21 as a result of an electrodynamic repelling effect, the fixedly clamping effect in the clamping region occurs, and therefore the advantageous effect of the delay of the bounce-back of the contact link.

LIST OF REFERENCE SYMBOLS

1 Service switching device
2 Pole current path
3 Input terminal
4 Output terminal
5,6 Fixed contact pieces
7 Moveable contact link
8,9 Moveable contact pieces
10 Contact point
11 Contact pressure spring
12 Thruster
13 Electromagnetic release
14 Line of action
15 Switching mechanism
16 Line of action
17 Active lever
18 Line of action
19 Slide
20 Striker pin
21 First opening, slot
22 Second opening
23 First shoulder
24 Second shoulder
25 Web
26 Shoulder
27 Bevelled side faces
30,31 Fork-like projection, limb
32,33 Free end of limbs
41 Journal, web
40 Housing
45 Pressure spring
113 Thermal release
114 Line of action
171 First lever arm
172 Second lever arm
173 Rotary spindle
S Direction arrow
O Direction arrow
I Pulse arrow
A Distance between free ends
$A_W$ Distance between limbs of shoulder 23
B Width of contact link

What is claimed is:

1. An electrical switching device comprising:

a contact point having two break-contacts;

a contact link having a width;

a contact pressure spring exerting a pressure on the contact link;

a striker pin configured to act on the contact link counter to the pressure of the contact pressure spring during a switch-off operation so as to move the contact link into an open position; and a thruster actuatable by a switching mechanism and configured to guide the striker pin, the thruster having two limbs projecting in a same direction towards a free end of the thruster so as to form a slot therebetween, wherein the contact link is received in the slot, wherein a distance between the two limbs tapers towards the free end such that the distance at the free end is smaller than the width of the contact link, so that the contact link is clamped between the two limbs during the switch-off operation.

2. The electrical switching device as recited in claim 1, wherein the two limbs are elastic.

3. The electrical switching device as recited in claim 2, wherein the first limb and the second limb are bent towards one another towards the free end.

4. The electrical switching device as recited in claim 3, wherein the two limbs form a V-shape in the region of the free end.

5. The electrical switching device as recited in claim 1, wherein the contact link is unclamped from between the two limbs by a further downward movement of the thruster.

6. The electrical switching device as recited in claim 5, further comprising a web or a journal and wherein the contact link rests on the web or the journal in a switch-off position, such that the further downward movement of the thruster unclamps the contact link from between the two limbs.

7. The electrical switching device as recited in claim 5, further comprising a spring, wherein the further movement of the thruster unclamps the contact link from between the two limbs.

* * * * *